United States Patent [19]

Parker et al.

[11] 4,041,429

[45] Aug. 9, 1977

[54] ELECTROMAGNETIC ACTUATOR

[75] Inventors: George E. Parker; Daniel C. Garvey, both of Fort Collins, Colo.

[73] Assignee: Woodward Governor Company, Rockford, Ill.

[21] Appl. No.: 678,559

[22] Filed: Apr. 20, 1976

[51] Int. Cl.[2] ..... H01F 7/08

[52] U.S. Cl. ..... 335/276; 335/279

[58] Field of Search ..... 335/203, 270, 272, 279, 335/276

[56] References Cited

U.S. PATENT DOCUMENTS

| | | | |
|---|---|---|---|
| 454,476 | 6/1891 | Hering | 335/279 X |
| 671,907 | 4/1901 | Duncan | 335/272 X |
| 2,449,901 | 9/1948 | Kaiser | 335/272 X |
| 3,435,395 | 3/1969 | Rosenberg et al. | 335/276 |
| 3,970,978 | 7/1976 | Langree | 335/279 X |

*Primary Examiner*—George Harris

*Attorney, Agent, or Firm*—Leydig, Voit, Osann, Mayer & Holt, Ltd.

[57] ABSTRACT

An electromagnetic actuator characterized by a pivotally connected stator and rotor (armature) forming a magnetic path linked by the coil and containing an air gap between the extremities of the stator and rotor. One such extremity is formed as a tapered arcuate tooth having inner and outer arcuate surfaces, and the other extremity is shaped to define a tapered arcuate mouth which fits complementally onto the tooth as the rotor pivots to a closed position. The coil mounted on the stator is formed with an arcuate passageway which receives the two extremities, coil thereby substantially surrounding the air gap while permitting the extremities to swing in a closing or opening sense relative to one another.

18 Claims, 13 Drawing Figures

ELECTROMAGNETIC ACTUATOR

BRIEF SUMMARY OF THE INVENTION

The present invention relates generally to electromagnetic actuators which are sometimes loosely called "solenoids". More particularly, the invention relates to rotary electromagnetic actuators of the type employed to move a member to a desired position which is determined by the magnitude of an input signal. While not so limited in its application, the present invention will find one advantageous use as an actuator for moving the throttle linkage of a governed engine in accordance with a control signal from the governor system so as to adjust the rate of fuel input in order to maintain desired engine speed as the set point or the engine load varies.

The desirability of and need for a linear rotary electromagnetic actuator have been recognized for several years. Hydraulic throttle actuators have been widely and almost universally employed in governor systems for prime movers principally because of their speed and high actuating force. But the hydraulic (piston and cylinder) actuator requires an hydraulic fluid (oil) reservoir, control valves, a pump and regulator to establish system pressure, and a mechanical take-off drive from the controlled prime mover (engine) to the pump. Such arrangements are relatively complex, expensive and space-consuming.

Linear, rotary electromagnetic actuators have been proposed, for example, in Rosenberg et al. U.S. Pat. No. 3,435,395 issued Mar. 25, 1969, but they have proven inadequate in many specific applications primarily because of inefficiency in converting electromagnetic forces into useful output torque. For example, the structure described by the above-identified Rosenberg patent produces useful output torque only from two small regions of fringing flux spanning the edges of the stator-armature gap, the greater proportion of the flux directly passing through the gap producing forces radially directed in relation to the pivot axis and serving only to load the bearings or pivot structure without contributing to any torque which tends to rock the armature about the pivot axis.

It is the general aim of the present invention to provide an improved rotary electromagnetic actuator which not only provides a substantially linear torque vs. input current relationship almost independent of output position, but also more efficiently produces output torque for a given total flux crossing the working gap.

A related object is to provide such a rotary electromagnetic actuator in which substantially all of the magnetic flux crossing the working gap contributes to the output torque, yet in which those components of force created radially of the pivot axis and bearings by two portions of the magnetic flux tend to cancel. In this respect, the net radial forces which do not participate in creating useful output torque, and which only deleteriously load the pivot or bearings, are minimized.

Another object of the invention is to provide an actuator in which magnetically created torque is substantially proportional to the value of excitation current and independent of changes in the position of the rotor—and to achieve this by special shaping of the rotor and stator surfaces which border and define a variable air gap.

Still another object is to provide such an electromagnetic actuator which includes a return spring, and yet wherein the magnetic torque vs. position characteristics of the actuator in effect create a negative spring scale, advantageously cancelling in part the actual spring scale of the return spring.

Finally, it is an object to provide an electromagnetic actuator characterized by improved efficiency and reliable long life achieved through the elimination of side loads on pivot bearing, reduction of radial loads on pivot bearings, and reduction of fringing flux at the working air gap.

DESCRIPTION OF THE DRAWINGS

These and other advantages of the invention will become apparent as the following description proceeds with reference to an exemplary embodiment illustrated in the accompanying drawings, in which.

Figure 2:
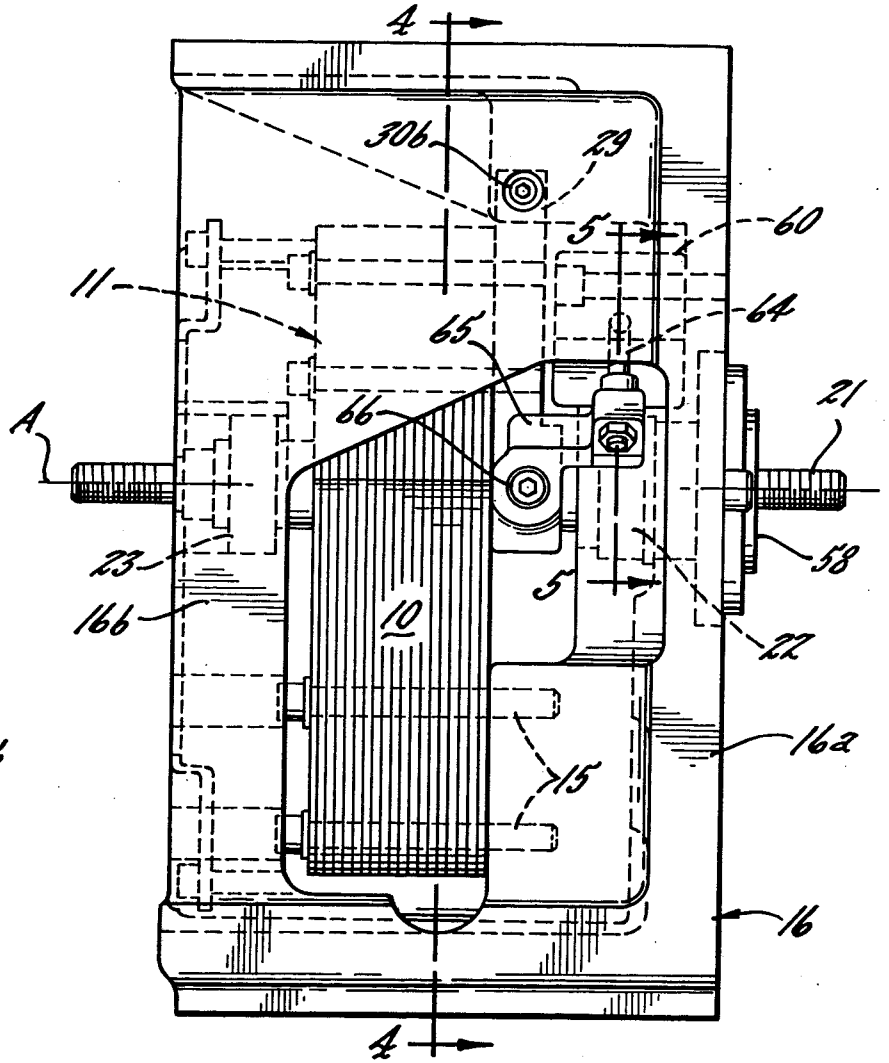
FIG. 2 is a rear elevation of the actuator shown in FIG. 1.
Figure 1:
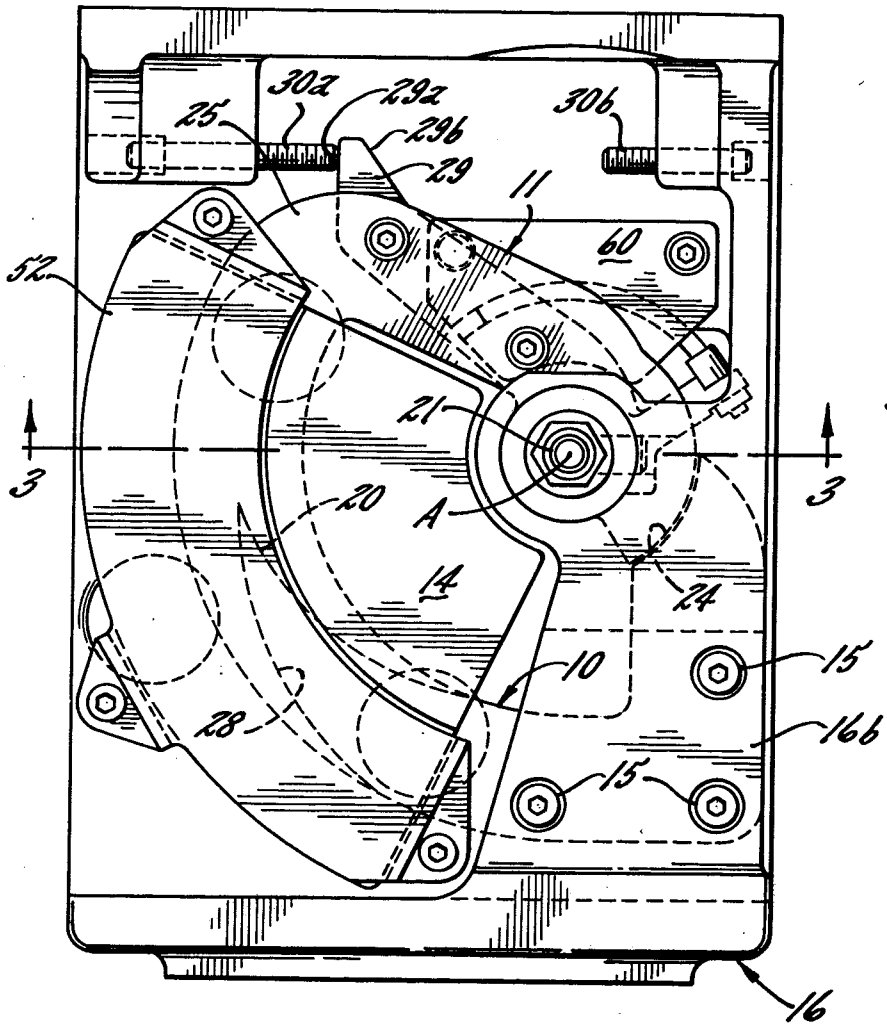
FIG. 1 is a side elevation of an electromagnetic actuator embodying the features of the invention.

While the invention has been shown and will be described in some detail with reference to a preferred and exemplary embodiment, there is no intention thus to limit the invention to such detail. On the contrary, it is intended here to cover all alternatives, modifications and equivalents which fall within the spirit and scope of the appended claims.

DETAILED DESCRIPTION

Referring to FIGS. 1-4, the present electromagnetic actuator is of the "rotational" type wherein a rotor swings about an axis relative to a stator as the excitation of an associated electromagnetic coil is varied. As its principal components, the device includes a permeable steel stator 10 associated with a permeable steel rotor 11 journaled or pivoted to swing about an axis A relative to the stator, so that a working gap 12 between the two, and disposed in a closed ring or loop magnetic defined by the two, closes or opens. A preformed coil 14 is disposed about and magnetically linked with that ring, so that excitation current creates an m.m.f. to drive magnetic flux $\phi$ in a closed path which includes the gap 12. Such magnetic flux $\phi$ attracts the rotor toward the stator, according to well known principles of magnetism, and tends thus to urge the rotor counterclockwise (FIGS. 2 and 4) to close the gap 12.

In somewhat more detail, the stator 10 is rigidly fixed by appropriate fasteners 15 to a base 16 having an upstanding side walls 16*a,* 16*b.* Although the exact configuration of the stator is unimportant (except for the tooth portion to be described) it is here shown as shaped to have an upstanding leg 18, a base portion 19 and an extremity formed as a curved, tapered tooth 20.

The rotor 11 on the other hand is fixed rigidly (as by a press fit) on a shaft 21 lying on the axis A and journaled by bearings 22, 23 in the upstanding side walls 16*a,* 16*b.* In the region of the axis A, the rotor and stator are formed with complemental arcuate surfaces concentric about that axis to define a very narrow air gap 24 (FIG. 4) on the order of 0.002 inch which has negligible reluctance to the travel of magnetic flux but permits relative rotation of the rotor. The rotor has an arm portion 25 and a depending extremity 26, the latter being shaped with a tapered arcuate mouth 28 to be described in greater detail.

The opposed surfaces of the mouth 28 and the tooth 20 define the working air gap 12 which narrows or widens as the rotor rocks c.c.w. or c.w. about the axis A (compare FIGS. 4, 6 and 7) and as the rotor extremity 26 approaches or retreats from the stator extremity tooth 20 with jaw-like motion. Generally stated, the rotor extremity is bi-furcated to form two fingers one either side and thereby defining the tapered mouth. In this way, the gap 12 is formed in two substantially equal halves lying respectively between the surfaces of the tooth 20, on the one hand, and the opposed surfaces of the mouth 28, on the other hand. The two halves of the gap are magnetically in parallel and flux threading the closed ring formed by the stator and rotor divides substantially equally to pass across the two halves of the gap. As will be apparent, both the tooth 20 and the mouth 28 are generally in the shape of the letter V, and they will complementally interfit (FIG. 4).

Figure 7:
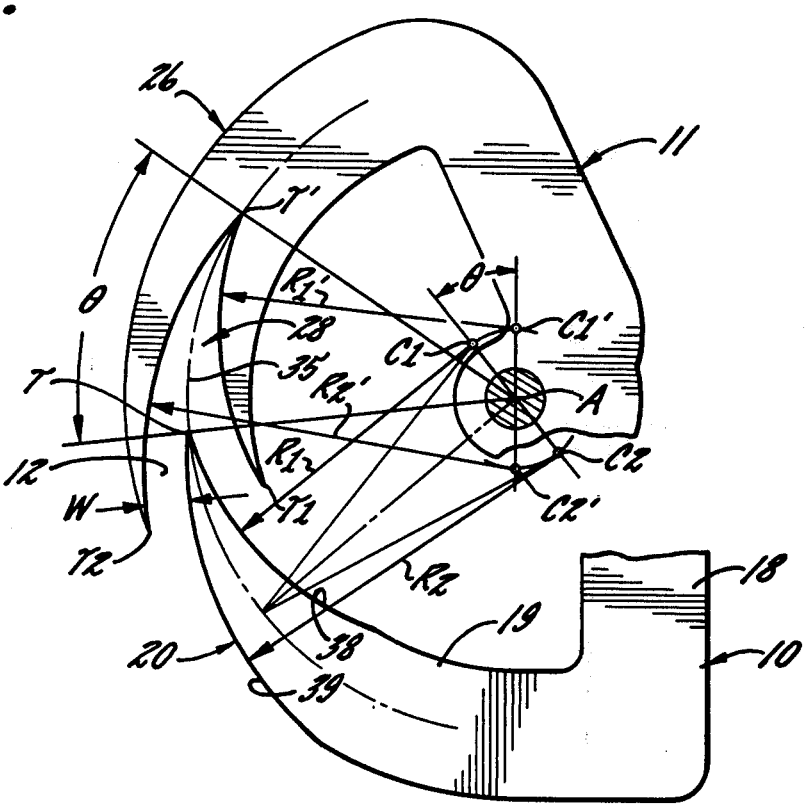
FIG. 7 is similar to FIG. 6 but shows the rotor in its "full open" position.
Figure 8:
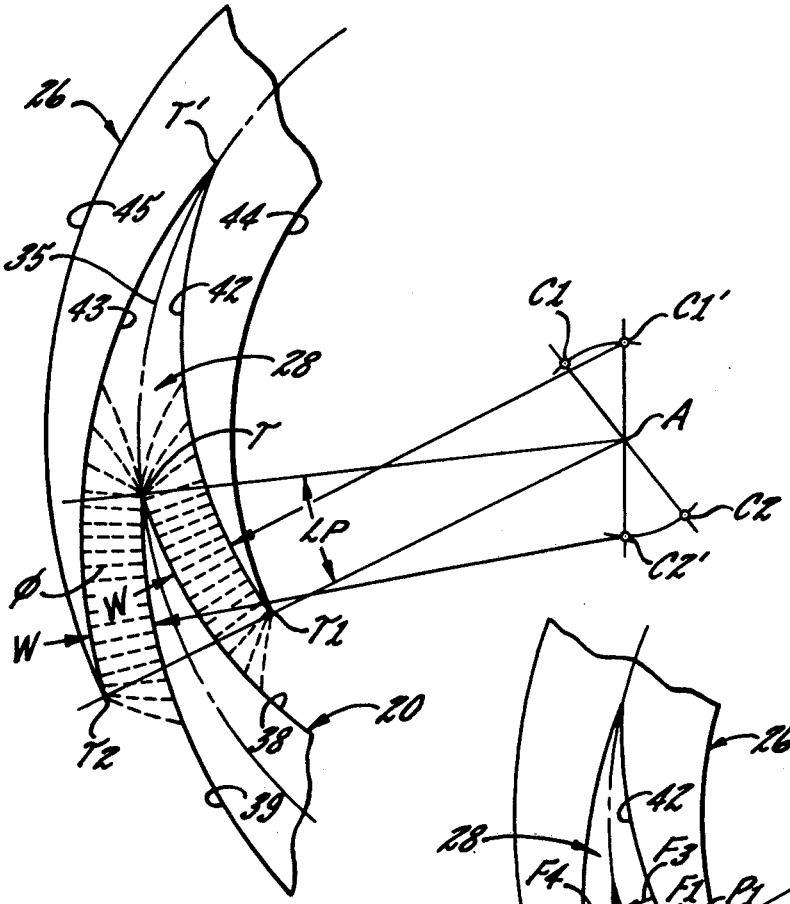
FIG. 8 is a fragmentary diagrammatic illustration of magnetic flux crossing the working air gap between the stator and rotor.
Figure 9:
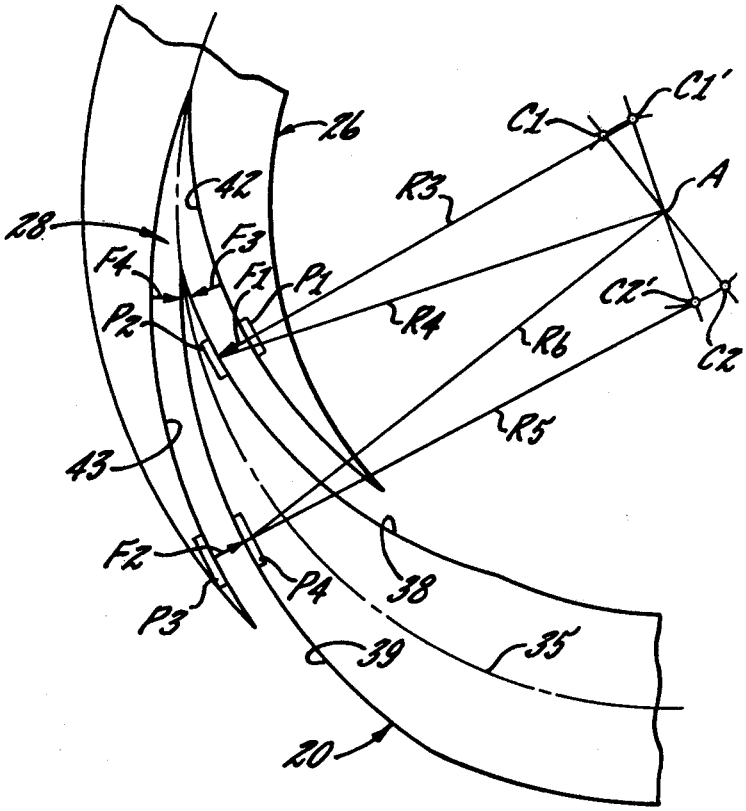
FIG. 9 is a diagrammatic illustration of the rotor and stator with construction lines to illustrate the directions of magnetically created force vectors.

To prevent the tooth and mouth surfaces from acutally touching and damaging themselves, and to limit the maximum extent to which the gap 12 can open, a finger 29 is fixed to the shaft 21 and bolted to the arm portion 25 of the laminated rotor. Tip surfaces 29*a,* 29*b* are adapted to engage stop screws 30*a,* 30*b* —and thereby limit the angular travel of the rotor to a predetermined span, here chosen as 40°. The stop screw 30*a* is adjusted preferably such that when the rotor is in its "fully closed" position, the interfitting mouth 25 and tooth 20 surfaces are just spaced apart sufficiently not to touch. Merely to facilitate the ensuing description, the angular position of the rotor 11 will be designated herein by the symbol $\theta$, it being assumed that $\theta = 0°$ when the mouth and tooth are wide open (with finger 29 against stop 30*b*) and that $\theta = 40°$ when the mouth and tooth are fully closed (with finger 29 against stop 30*a*). FIGS. 1-4 show the parts fully closed ($\theta = 40°$), FIGS. 7 and 8 show them fully open ($\theta = 0°$), and FIGS. 6 and 9 show them half closed ($\theta = 20°$).

Figure 4:
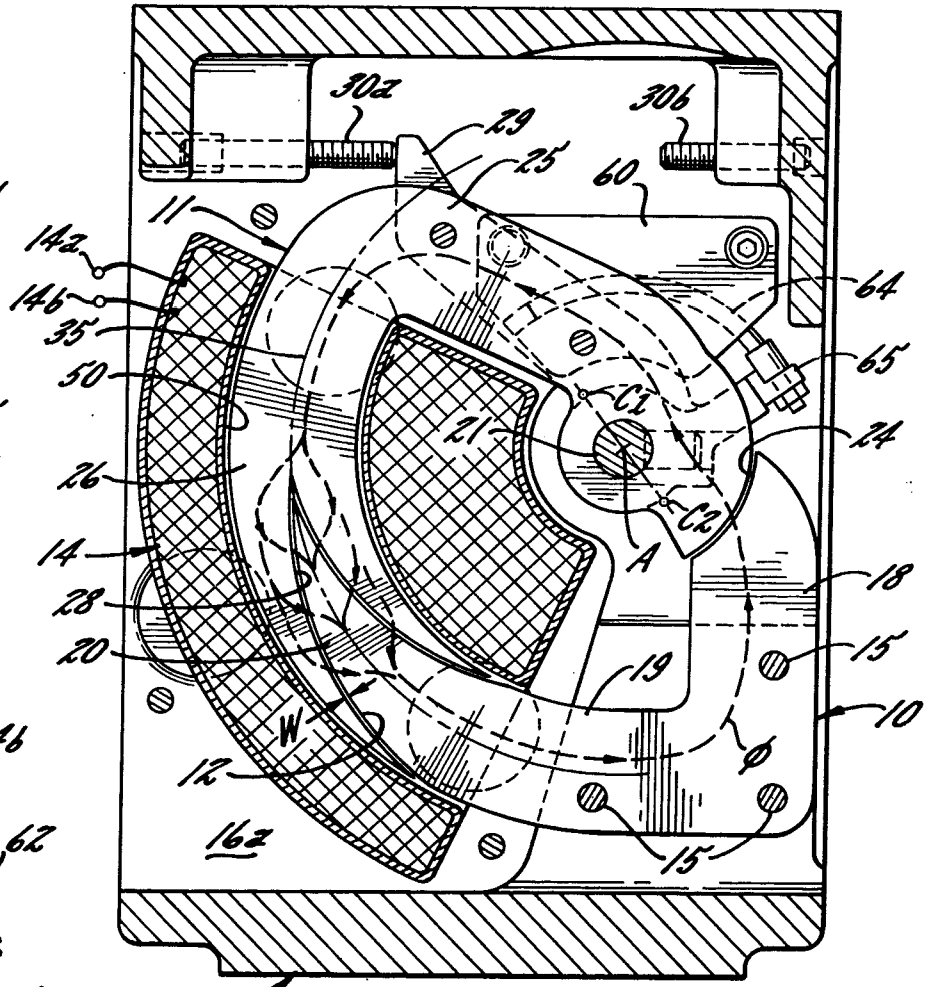
FIG. 4 is a vertical sectional view taken substantially along the line 4—4 in FIG. 2.
Figure 3:
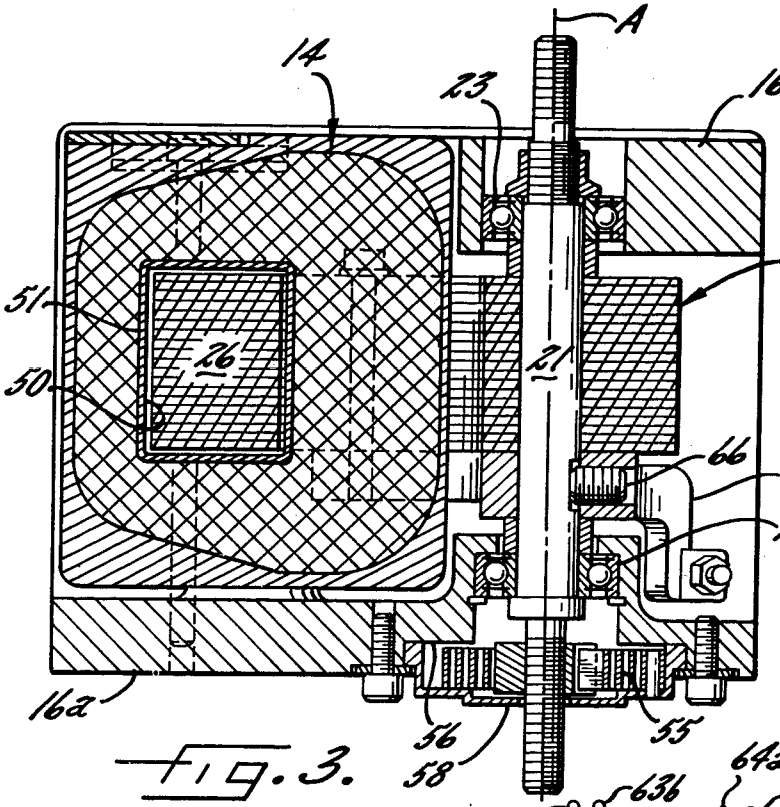
FIG. 3 is a horizontal sectional view taken substantially along the line 3—3 in FIG. 1.

In accordance with the present invention, the extremities of the stator and rotor, which may swing relatively about axis A toward or away from one another, are geometrically arcuate in shape but also complementally tapered so that they will nestingly interfit when fully closed (as shown in FIG. 4). To construct the stator and the rotor, stamping dies may be first made and then used to stamp from sheet steel stock the individual laminations which are then stacked and held together preferably by thin coats of epoxy adhesive, thereby to avoid the need for rivets or the like. Stacked laminations are preferably employed to reduce eddy current losses, even though it is contemplated that the coil 14 will be excited by a variable direct current, as contrasted with alternating current —and more particularly to reduce eddy currents and the inductance of the coil 14 in those cases where single polarity, variable duty cycle, pulsating dc. current is chosen to excite the coil with a variable average dc. current. The laminations thus reduce the electrical time constant of the coil 14. Alternatively, however, the stator and rotor may be machined from solid ferromagnetic metal stock, or they may be formed of metal powder pressed in a mold to the desired shape and sintered into homogeneous elements.

Figure 6:
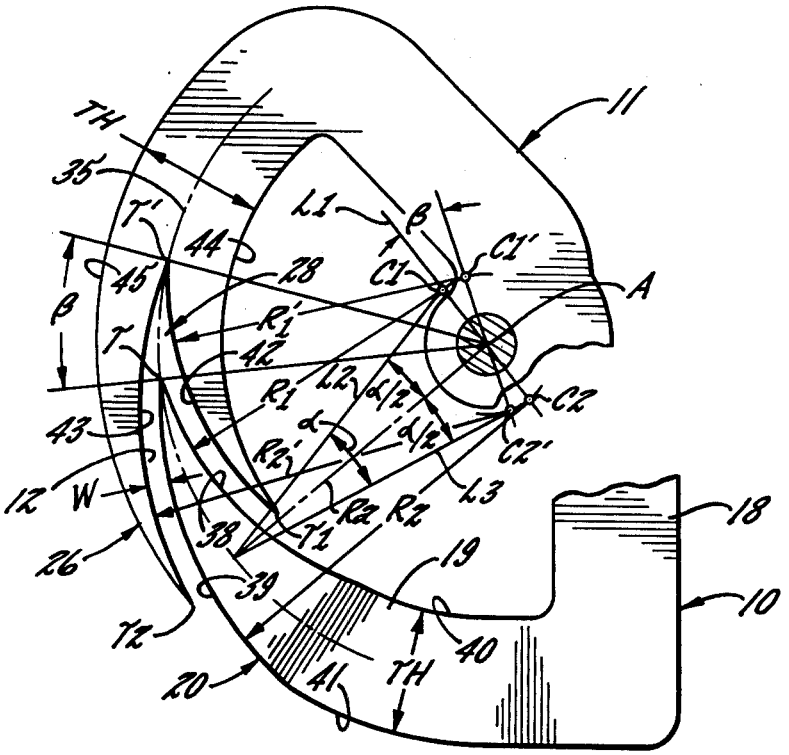
FIG. 6 is a diagrammatic illustration of the actuator with the rotor in its "half closed" position.

To gain an understanding as to the shape of the complemental tooth 20 and mouth 28, observe from FIGS. 4 and 6 that the tooth 20 of stator 10 has a center line 35 which lies on an arc struck with any selected radius $R_a$ about the pivot axis A. An included angle (here designated $\alpha$) for that tooth 20 is arbitrarily chosen, it being noted from experiments that values within the range of about 15° to 26° yield best performance in the completed device. A line L1 is drawn through axis A normal to the radius $R_a$; centers C1 and C2 are located thereon which lie equally and diametrically spaced on opposite sides of the axis A. This diametric spacing is chosen such that the angle $\alpha$ has the desired value. Thus, lines L2 and L3 drawn from the terminus of radius $R_a$ on center line 35 form equal angles $\alpha/2$ with that radius line. Stated another way, centers C1 and C2 are located equally and diametrically on opposite sides of the axis A by a distance chosen to make the angle $\alpha$ correspond to the value chosen for the included angle of the tooth 20.

With the centers C1 and C2 so located, the inner and outer surfaces 38, 39 of the tooth 20 are shaped to lie along arcs struck from a common point T on center line 35 about those two respective centers. FIGS. 4 and 6 make it clear that the inner surface 38 (closest to axis A) lies on an arc of radius $R_1$ about center C1; whereas surface 39 lies on an arc of radius $R_2$ about center C2. Since $R_2$ is greater than $R_1$, the resultant is a tooth shape which is not only arcuate but which tapers in width from the stator base portion 19 to the relatively sharp tip at T where the surfaces 38, 39 intersect and terminate. Assuming that the base portion 19 is designed to have a thickness TH, the surfaces 38 and 39 merge into arcuate surfaces 40 and 41 which lie on arcs struck about axis A, the radius of surface 41 being greater by the amount TH than the radius of surface 40.

For the rotor 11, the extremity 26 is cut or stamped out to define the mouth 28 with interior surfaces 42, 43 shaped to complementally mate with the surfaces 38, 39 when the rotor is fully closed. Since the pivot axis A has a definite location in relation to the stack of rotor laminations, it may be assumed that the rotor has been rotated about point A by any angle $\beta$ (FIG. 6, wherein $\alpha$ is 20°) so that those on the rotor originially coinciding with stator centers C1 and C2, with the rotor fully closed, now lie at locations C1′ and C2′. Now, the surfaces 42 and 43 (the inner and outer interior surfaces of the mouth, in the sense that they are respectively closer to or farther from axis A) are shaped to lie along arcs drawn from a point T′ on the center line 35 (the point T′ being displaced along center line 35 from point T by the same assumed angle $\alpha$) with radii $R_1'$ and $R_2'$ about centers C1′, C2′. The radius $R_1'$ is essentially equal to radius $R_1$, except perhaps very slightly less in a commercially manufactured product; likewise, the radius $R_2'$ is essentially equal to the radius $R_2$, except perhaps very slightly greater. It will thus be apparent that mouth surfaces 42, 43 will complementally mate with tooth surfaces 38, 39 when the rotor is fully closed (FIG. 4).

Since the centers C1′, C2′ respectively coincide with centers C1, C2 when the rotor 11 is in its fully closed position (FIG. 4), it may be stated that the surfaces 42 and 43 lie on arcs having radii equal to $R_1$ to $R_2$ struck about the centers C1, C2 when the rotor is in fully nested position.

The exterior surfaces 44, 45 of the rotor extremity 26 are spaced by the chosen thickness TH mentioned above. These surfaces are shaped to lie on arcs drawn about the axis A as their center, the radius of the first being less than the radius of the second by the amount TH. Thus, the surfaces 44 and 45 are coaxial about the axis in the same way as the surfaces 40, 41 and in all positions of the rotor the surfaces 44 and 45 lie on extensions of the arcs which define surfaces 40 and 41. The intersections T1 and T2 of the surfaces 44 and 45 with the surfaces 42 and 43 create the terminii of the rotor extremity 26. It will be seen that "full closure" of the rotor onto the stator tooth (FIG. 4) makes the closed ring or loop (linked by coil 14) have a substantially continuous (except for the very narrow working gap) arcuate portion of uniform thickness TH measured along any radial line drawn from the axis A.

As the rotor is rocked from its full nest ($\theta = 40°$,FIG. 4) position progressively toward its half open ($\theta = 20°$, FIG. 6) position, and then toward its full open ($\theta = 0°$, FIG. 7) position, the width W of the working gap 12 progressively increases. Likewise, the extent of the overlap of surfaces 42, 43 with tooth surfaces 38, 39 (measured generally along the center line 35) progressively decreases. Recognizing that the working gap 12 is formed by two symmetrical halves (from surface 42 to surface 38, and from surface 43 to surface 39), it may be seen that as the angle $\theta$ increases from 0° to 40°, width of the gap decreases as a function of $\theta$ while the effective area of the gap increases as a function of $\theta$.

In keeping with another important aspect of the invention, the electromagnetic coil 14 is mounted in fixed relation to the stator 10, and is wound and shaped to define an interior passageway 50 (FIG. 4) which is arcuate in configuration, with a breadth only slightly greater than the chosen dimension TH. More generally, the coil's interior passageway is shaped to conform with close spacing to the exterior of the rotor and stator in the region of the gap 12 when the parts are "fully closed" (FIG. 4), and even if the cross sectional shape of the parts in that region is chosen to be other than rectangular (as shown at 26 in FIG. 3). The coil 14 may be wound with an appropriate number of turns of wire of a chosen gage to provide the desired range of ampere-turns of m.m.f. These factors of choice are within the ordinary skill of those working in the art, and will depend upon the desired range of excitation current, the available range of excitation voltage, and the maximum actuator torque desired. But in greater detail, and as indicated in FIG. 4, the coil 14 is preferably wound and then encased in an insulating container 51 which defines the inner and outer surfaces of the passageway 50 as arcs struck about the axis A when the tooth 20 and the extremity 26 are telescoped into that passageway at the time the parts are assembled. The coil is then fixed in place by a retainer plate 52 (FIG. 1) bolted to the upstanding walls of the base 16. In the preferred coil arrangement (FIG. 4) two equal volumes (for the windings) are disposed inboard and outboard of the extremities 20 and 26—the first volume being radially thick and circumferentially short, while the second volume is, relatively, radially thin and circumferentially long. The magnetic coupling of the m.m.f. of the excited coil to the closed ring, permeable flux path formed by stator 10 and rotor 11 is thus applied directly in the region of the gap 12. This affords freedom for the rotor extremity to move in an opening or closing direction within the passageway 50, yet applies the m.m.f. in the region of the gap 12 and minimizes the tendency for the flux to fringe at the edges of the gap-defining surfaces.

It will be understood, of course, that as excitation current is supplied through terminal leads **14*a*, 14*b* of the coil, the m.m.f. of the latter creates flux $\phi$ (FIG. 4) threading the closed ring or loop and dividing to pass in substantially equal portions across the two halves of the working gap which lie symmetrically on either side of the center line 35.** The resulting magnetic attraction creates torque tending to pull the rotor counterclockwise about the axis A and tending to move the rotor toward its fully closed position.

To be certain that a reduction in coil exciting current, and a reduction in the c.c.w. magnetic torque, causes the rotor to return in a c.w. direction, a suitable biasing spring is associated with or incorporated into the actuator. In the present example, a ribbon "clock type" torsion spring 55 acts in a c.w. direction on the shaft 21 and thus on the rotor 11. The spring 55 (FIG. 3) is disposed about the shaft 21 within a cavity 56 formed in the base wall **16*a*. The inner end of the spring is fixed to the shaft 23, and the outer end locked to the base wall, a retainer 58** holding the spring in place.

As will be noted below, the spring preload torque (when $\theta = 0°$) and the spring scale constant may be chosen according to the particular usage which is to be made of the actuator.

Figure 5:
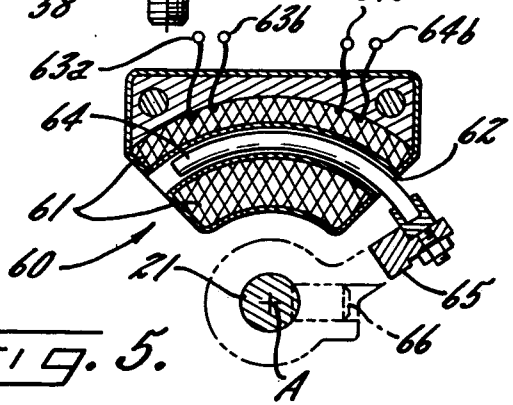
FIG. 5 is a fragmentary section taken substantially along the line 5—5 in FIG. 2 and showing details of a position-signaling transducer.

In many applications of the present actuator, the load device or actuated member (which is connected to shaft 21 to be moved by the rotor as the latter rotates) is not known in advance, and may impose different and even variable torque loads on the rotor as it is moving. In these circumstances, it may be desirable to employ position feedback in a closed servo loop to assure that the rotor moves to a steady state position which agrees with the value of an input position command signal. Thus, a position-to-electric signal transducer may often be desired for feedback. In the present example, such built-in transducer takes the form of a linear variable differential transformer (LVDYT 60 (FIGS. 4 and 5) constructed of windings 61 on an arcuate coil form 62 and constituting primary and secondary windings having input and output terminals **63*a*, 63*b* and 64*a*, 64*b*. The coil form and support is bolted to the base wall 16*a* with its arcuate passage concentric about the axis A . That passage receives an arcuate slug or armature 64 carried by a bracket 65 locked (but adjustably positionable) on the shaft 23 by a set screw 66. With the primary winding terminals 63***a*, 63*b* excited from a reference ac. voltage source, movement of the rotor to different positions $\theta$ shifts the armature 64, thereby varying the coupling between the primary and secondary windings. As is well known with respect to LVDT's, the ac. output voltage varies in amplitude and phase polarity (relative to the input reference) according to the magnitude and sense of the displacement of the armature from a neutral or null position. By applying such output voltage to a discriminator, it may be converted into a dc. voltage or current which in magnitude and polarity corresponds to and represents the actual position (relative to a null reference position) of the rotor 11.

FIG. 8 illustrates the general distribution of the magnetic flux lines $\phi$ crossing the two symmetrical halves of the working gap between the exterior surfaces of the stator tooth 20 and the interior surfaces of the rotor mouth 28—assuming that the coil 14 is excited with dc. current of a given value and that the rotor is "full open" ($\theta = 40°$). It may be observed that the major portion of the flux extends directly across the gap on lines which lead approximately to the centers C1' and C2', because flux tends normally to leave or enter permeable surfaces at right angles (i.e., normal to tangents drawn at various points along the arcuate surfaces). Some fringing flux extends from the region of tip T to the interior surfaces of the mouth, and also from the exterior surfaces of the tooth to the rotor extremity tips at T1 and T2. Because of the tapering to tips T, T1 and T2, however, it is believed that the laminations in the immediate regions of these tips tend somewhat to saturate—so that fringing is greatly reduced and exists to an extent less than would appear from the curved flux lines drawn in FIG. 8. If this belief is in fact correct, then most of the flux $\phi$ crossing the working gap extends directly and almost perpendicularly from the tooth surfaces to the opposed surfaces of the rotor mouth. Between surfaces 38 and 42 these flux lines lie, to a close approximation, along radial lines extending back to the center C1'; between surfaces 39 and 43, these flux lines lie approximately along radial lines extending back to the center C2'—even as these centers move about axis A when the rotor position changes.

The creation of a working gap which has, in effect, two halves lying on opposite sides of the arcuate, tapered tooth—with each portion having an equal width W (which changes as the position $\theta$ changes) —results in marked operational advantages. First, the net reactive force on the rotor which acts radially through the axis A (and radially loads the bearings 22, 23) is greatly reduced. This results because all of those vector components of the magnetic forces acting between (i) surfaces 38 and 42 on the one hand and (ii) surfaces 39 and 43 on the other hand, in directions passing through the pivot axis A, are substantially equal and opposite in sense. They thus tend to cancel, and the inefficient application of magnetic attraction which serves only to radially load the pivot or bearings, and which does not produce useful c.c.w. torque tending to pull the rotor rotationally about the pivot axis, is avoided. But by contrast, all of those vector components of magnetic forces in both portions of the working gap, and which act at right angles to radial lines drawn from the axis A , act in the same sense and additively combine. It is these latter vector components which create the total c.c.w. torque on the rotor.

The foregoing may be better appreciated by reference to FIG. 9. Although the flux lines and forces are distributed over the entire working gap, a typical magnetic force element F1 is shown between surfaces 38, 42; and a typical magnetic force element F2 is shown between surfaces 39, 43. These forces may be viewed as acting between infinitely small pairs of parallel plates P1, P2 and P3, P4—such forces tending to pull the first plate of each pair toward the second one. The plates P1, P2 are tangent to the curved surfaces 42, 38 respectively at the points where the force F1 acts; thus those plates lie at right angles to a radial line $R_3$ passing through both of the centers C1 and C1'; and the force F1 is directed along that radial line. It is to be observed that the line $R_3$ and the force element vector F1 makes an acute angle with a radial line $R_4$ drawn from the axis A to the plate P2. Similarly, the plates P3, P4 are tangent to the curved surfaces 43, 39 respectively, at the points where the force F2 acts. Those plates lie at right angles to a radial line $R_5$ passing through the centers C2 and C2' and the force F2 acts along that line in a direction which makes an acute angle with the radius $R_6$ extending from the axis A to plate P4.

If one next considers individual flux lines crossing the working gap and creating elemental forces (in addition to the forces labeled F1 and F2) it will be understood that such other forces are not perpendicular to both of the opposed arcuate surfaces of the gap. Yet, they closely approximate that relationship and it is sufficient for purposes of analysis to assume that such other elemental forces (e.g., those labeled F3 and F4) lie along lines drawn from the centers C1' and C2' as radii for the arcuate surfaces 42 and 43. These lines are almost normal to the surfaces 38 and 39 because they approach very closely passing through the respective centers C1 and C2.

Figure 10:
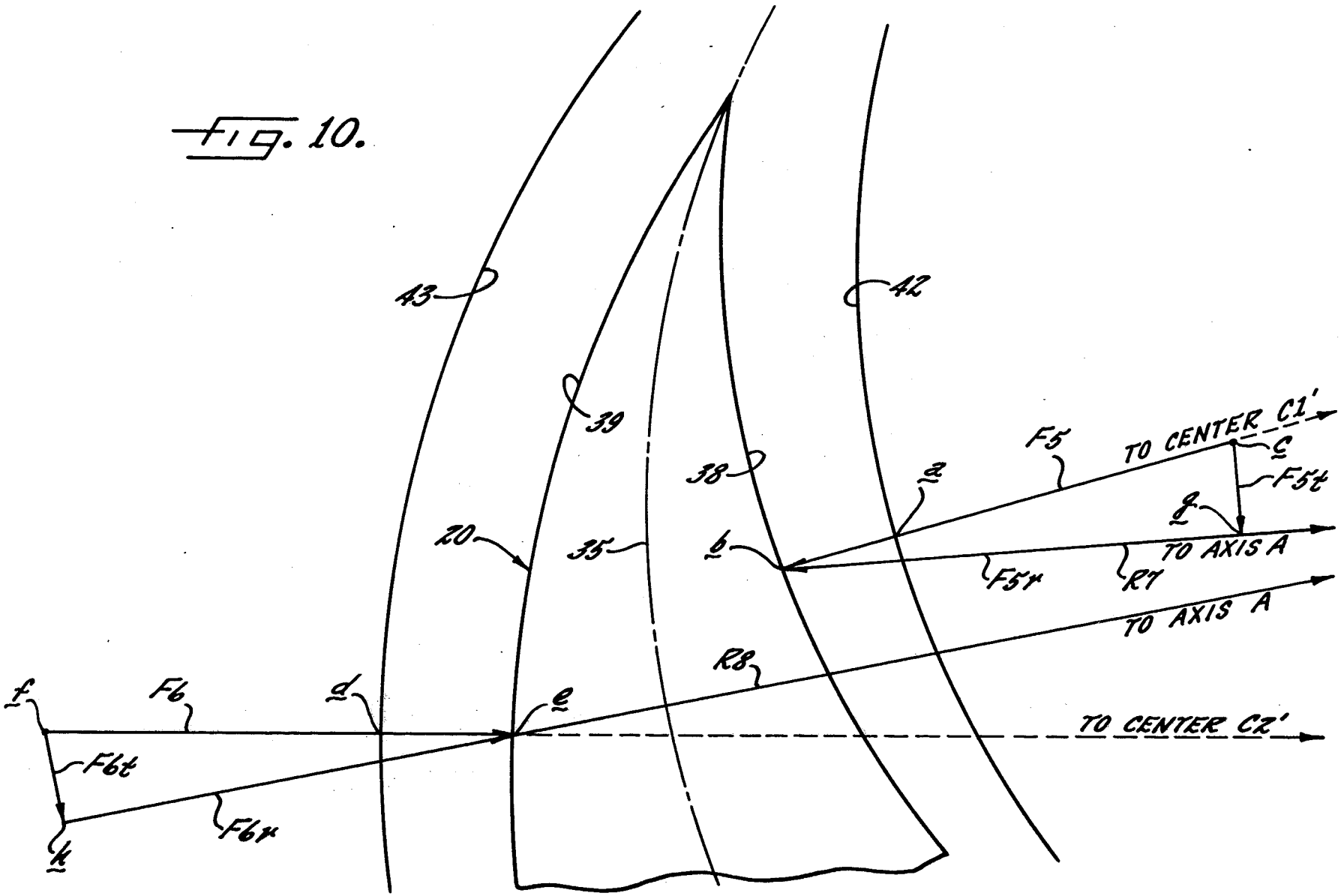
FIG. 10 is an enlarged, fragmentary diagram to illustrate more clearly the spacial relationship and vectors of FIG. 9.

Because the small scale of FIG. 9 makes it difficult to visualize resolution of force vectors, FIG. 10 has been drawn to a much larger scale, and with the rotor position $\theta$ approximately equal to 28°. Although FIG. 10 is not drawn rigorously to scale, it reflects the principles noted above. To represent an elemental magnetic attraction force acting from point *a* to point *b* on surfaces 42 and 38, a force vector F5 is drawn between those points and given a length *c-b* to represent a predetermined magnitude. The vector F5 lies along a line drawn from center C1' to point *a,* so that it acts perpendicularly to the surface 42 (and approximately perpendicularly to the surface 38).

In like fashion, an elemental magnetic attraction force acting from point *d* toward point *e* is represented by a force vector F6 passing through those points and given a length *f-e* equal to length *c-b* to represent the same magnitude of force. The vector F6 lies along a line drawn from point *d* to the center C2' so that the force acts perpendicularly to surface 43 (and approximately perpendicularly to surface 39). The vectors F5 and F6 are properly shown as being of the same length because the right and left halves of the gap are very nearly (although not exactly) of the same width, so that the flux density and elemental magnetic forces in the immediate regions of points *a* and *d* are equal for any given magnitude of total m.m.f. created by the excited coil 14.

FIG. 10 shows that the equal force vectors F5 and F6 each may be resolved into two components which respectively lie (i) along a radial line extending to the axis A and (ii) perpendicularly to such line. That is, vector F5 is made up of a rightward component F5*r* which extends from $g$ to $b$ and lies along a radius $R_7$ betwen axis A and point $b$. The vector F5 also has a component F5$t$ lying at right angles to radius $R_7$ between points $c$ and $g$.

Similarly, the vector F6 is composed of components F6$r$ and F6$t$. The former lies along a radial line $R_8$ passing through point $e$ and axis A; the latter is perpendicular to radius $R_8$ and of length $f$-$h$.

From this vector diagram, one may see that for each elemental magnetic force due to flux crossing the right side of the working gap there is a "paired" approximately equal elemental magnetic force due to flux crossing the left side of the working gap. When resolved, these forces are made up of substantially equal and opposite components (such as F5$r$ and F6$r$) which act through the pivot axis A but essentially cancel one another. Thus, radial loading of the bearings or pivot for the rotor 11 in the present actuator is indeed reduced if not essentially avoided. But on the other hand, the "paired" elemental forces F5 and F6 have substantially equal components F5$t$ and F6$t$ which act in the same direction (and thus add) perpendicular to radial lines $R_7$ and $R_8$ passing through the axis A. These latter components tend solely to rotate the rotor about the axis A relative to the stator —and thus they both create c.c.w. torque.

Of course, the vectors F5 and F6 in FIG. 10 are representative of a multitude of elemental magnetic forces which exist between the opposed boundary surfaces of the working gap when the coil 14 is energized. But even as the excitation of the coil is varied, and even as the rotor resides in different angular positions, each elemental force on one side of the gap will have a paired counterpart on the other side, and the relationships here explained will exist as to all such pairs.

In summary, the configuration here described for the present actuator creates two halves for a working gap and causes the radial components of force (which would only load the bearings) to substantially cancel; but the useful, torque-producing components cumulatively add.

To create a theoretically perfect linear actuator, its operational characteristics should be such that (a) for any given coil excitation current, the magnetic attraction torque is essentially constant as the angular position of the rotor 11 is varied over its working range, and (b) with the rotor in any angular position, the magnetically exerted torque is essentially proportional to the magnitude of coil excitation. The actuator here described has been found to approach these desired characteristics, and its actual operational character is represented in non-rigorous, idealized form by the graphs of FIG. 11. As there indicated, the magnetically created c.c.w. torque T$m$ (expressed for example in inch-pounds) varies with the rotor angle $\theta$ according to the family of essentially straight lines represented by lines 60, 61, 62, 63 when the excitation current supplied to the coil 14 is given respective values of $\frac{1}{4}$ I, $\frac{1}{2}$ I, $\frac{3}{4}$ I and I —, the symbol I representing the value (e.g., 10 amperes) of the nominal, rated maximum current for the coil. Ideally, the characteristic lines 60-63 would fall in the horizontal locations 64-67, respectively. But tests have revealed that the characteristic lines generally have a slight positive slope, indicating that torque T$m$ increases slightly as $\frac{1}{4}$ increases while excitation current is held constant. On the other hand, the characteristic lines 60-63 have been found to be substantially equally spaced in a vertical direction, and they represent a whole family of lines for various values of excitation current, confirming that as excitation current is varied, the torque T$m$ proportionally changes.

The magnetic variations and relationships which result in these functional characteristics are not fully understood. It will suffice to say that such characteristics (although here shown in idealized and non-rigorous form) have been determined by tests to result from the rotor, stator and coil construction previously described. If the rotor and stator are constructed with the angle $\alpha$ greater than about 26° or less than about 15°, there is a significant departure from the idealized operation illustrated. A value of 22 $\frac{1}{2}$° for the angle $\alpha$ has been found to yield the closest approximation to the characteristics 60-63 shown in FIG. 11. It is believed that the performance characteristics result from the fact that some saturation and non-linearities in flux versus m.m.f. relationships occur as the rotor angle $\alpha$ and the coil excitation current $i$ are varied, so that the torque T$m$ does not drastically increase as an angle $\theta$ increases and the gap 12 narrows.

If the actuator as described is constructed to include a torque spring 55 which has a relatively large linear spring constant, then as the position angle $\theta$ increases the spring exerts a negative (c.w.) torque as represented by the line -T$s$. as the coil excitation current is given different values, therefore, the rotor 11 will come to rest at steady state positions in which magnetic torque T$m$ and spring torque T$s$ are equal and opposite. For coil currents of $\frac{1}{4}$ I, $\frac{1}{2}$ I, $\frac{3}{4}$ I and I, the rotor position $\theta$ is very closely equal to 10°, 20°, 30° and 40°, respectively. This confirms that, in cases where the rotor is coupled to move a member of negligible mass and not subject to friction, the present actuator may serve as a linear current-to-position transducer. Assuming maximum rated coil current I is 10 amperes, as the excitation of the coil is given any value between 0 and 10 amperes the rotor and its driven member will reside at 0° to 40°, i.e., the actuator will have a proportionality factor of approximately 4° per ampere.

In many cases, however, the "actuated" member to be coupled to the rotor is relatively massive or its nature is such that there is some static and dynamic friction resistance to its movement. The magnitude and nature of the load imposed by the actuated member is not known in advance and may be different in different applications. In such cases, the actuator must deliver output work in moving that member from one position to another. Moreover, the torque to overcome stiction and to accelerate the mass to produce a fast response must be relatively great. In these instances, it is desirable not to apply the magnetic torque T$m$ almost wholly to overcome the return spring, and position feedback in a closed servo loop is preferably employed.

In such arrangements the torsion return spring 55 is preferably chosen to have a relatively low, linear spring scale (expressed as in. -lbs. per degree) and it is inserted into the actuator assembly with a relatively large preloading. As a preferred example, the spring 55 is "wound up" or preloaded before assembly as an active element interposed between the stator and rotor, the preload preferably being adjusted so that the spring exerts a negative (c.w.) torque of -$T_{sp}$(when the rotor 11 is in its full open position with finger 29 against stop 30$a$ and $\theta = 0°$) equal to one-half the value of the maximum magnetic torque T$m$. This means that the excitation current $i$ of the coil required to hold the rotor in any steady state position (and absent any reactive force from the actuated member) will be almost equal to the mid-value of the exciting current range (e.g., 5 amperes, assuming maximum rated current is 10 amperes).

Figure 12:
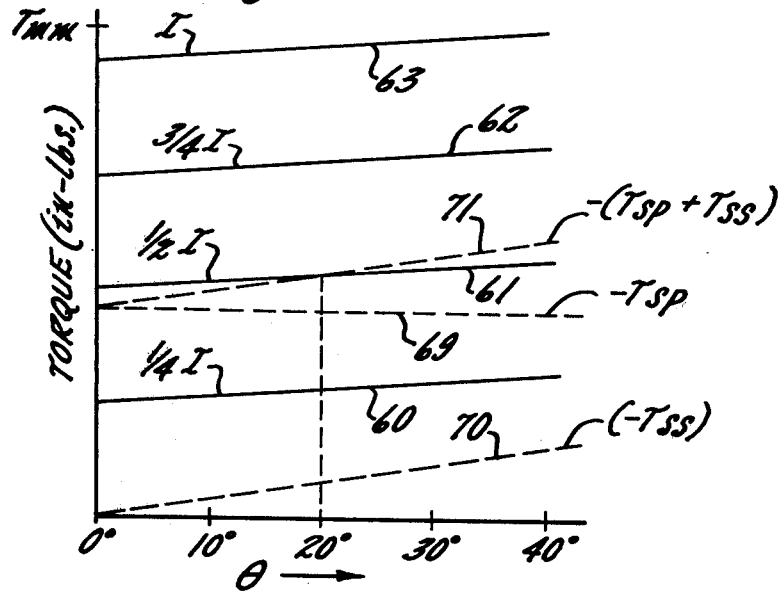
FIG. 12 is a graph similar to FIG. 11 but illustrating the effect of a preloaded return spring with a low spring scale constant.

Consider for example FIG. 12 which shows by line 69 the preload torque $-Tsp$ from the spring 55 equal approximately to one-half the maximum magnetic torque $Tmm$. The changeable portion $-Tss$ of the spring torque is represented by a line 70 of relatively shallow slope (i.e., small spring scale in dimensions of in. -lb. per degree). As the rotor 11 position $\theta$ varies from 0° to 40° the total spring torque varies according to line 71 which is the sum $-(Tsp+Tss)$. It is to be noted that the slope of the line 71 is preferably chosen to approximate the slopes of lines 60-63 and that preferably the c.w. torque of the spring 55 equals the mid-current c.c.w. magnetic torque at the mid-point of position range. That is, as shown in FIG. 12, the lines 61 and 71 intersect when $\theta = 20°$.

Figure 13:
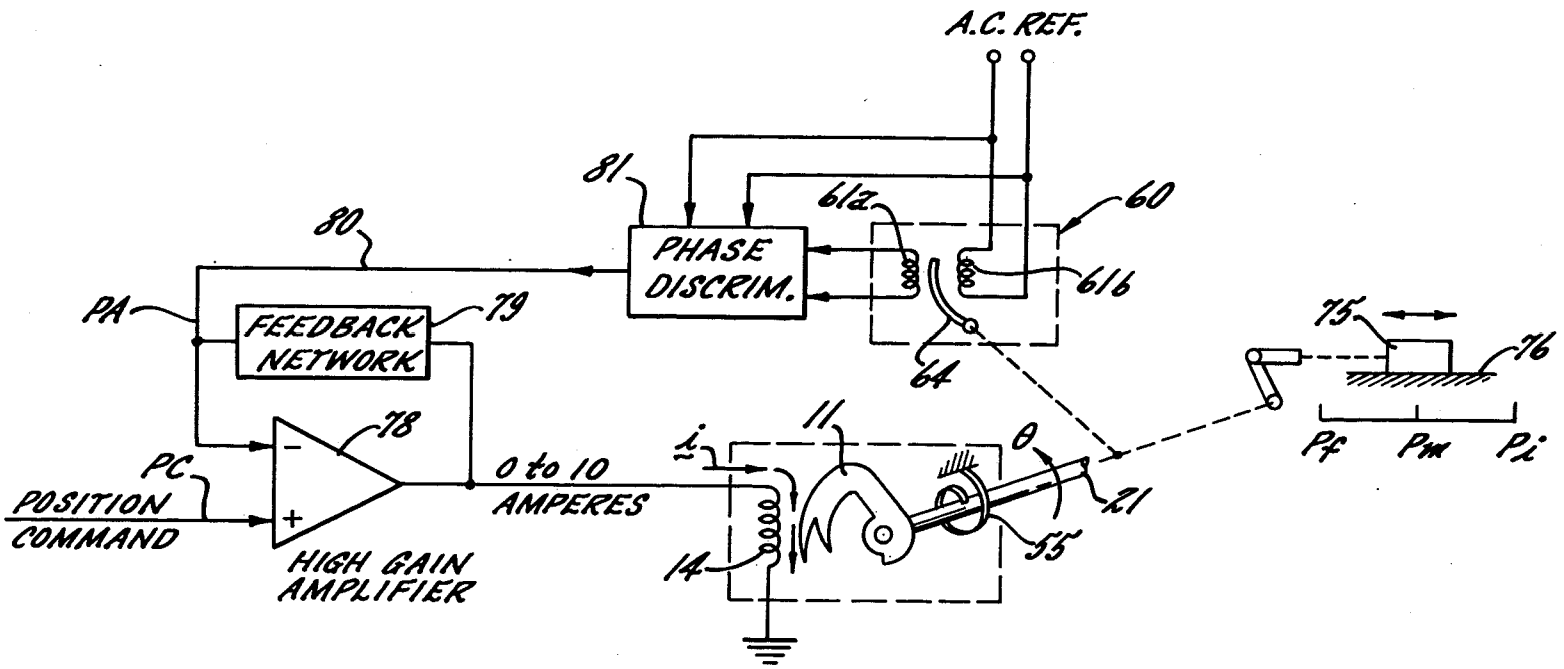
FIG. 13 is a block diagram illustrating the use of the electromagnetic actuator in a signal-to-position transducer system with position feedback.

With the spring 55 so selected and installed, the present actuator may be made a part of a closed loop servo system as diagrammatically illustrated in FIG. 13. The shaft 21 is coupled to movably position an engine throttle member 75 which slides with stiction and friction on a surface 76 between an idle position P*i* and a full fuel position P*f*, but which normally resides at some intermediate position P*m* to keep a governed engine (not shown) running at set point speed despite load changes. The servo system as here illustrated receives a throttle position command signal PC from the governor system, such signal being variable, for example, over a range from 0 to 1.0 volts and being applied to the non-inverting input of a high gain summing operational amplifier 78 having negative feedback via a network 79. Preferably the amplifier is constructed so that it operates with very high gain proportional action and with derivative action to impart anticipation and velocity damping. The design of a suitable amplifier, which of course may include several stages and a final voltage-to-current conversion stage, for fast response and loop stability, is within the skill of the art. The inverting or (−) input of the amplifier receives a dc. feedback voltage via line 80 which is an actual position signal PA. This comes from a phase discriminator 81 which compares the output from the secondary winding 61*b* of the LDVT 60 with the reference ac. voltage applied to excite the primary winding 61*a*. As the shaft 21 and the throttle member 75 move from zero to full-scale positions (position of rotor 11 varies from $\theta = 0°$ to $\theta = 40°$) the dc. feedback voltage on line 80 varies, for example, from 0 to 1.0 volts.

The output of the amplifier 78 is a dc. current which may, for example, swing within the range of 0 to 10 amperes, such output being fed as the excitation current *i* to the coil 14.

Consider now FIG. 12 with reference to FIG. 13. Whenever the command signal PC is greater than the actual position signal PA, the output current *i* of amplifier 78 will increase to a value representing a high gain function of the error (PC-PA). The greater excitation current *i* will thus increase the magnetic torque T*m* and the rotor will move clockwise to shift the member 75 against retarding forces such as friction. But such movement increases the actual position signal PA, and thus reduces the error (PC-PA) progressviely. And when that error is reduced to a very small value, the output of the amplifier 78 ceases to change, so that the coil excitation current takes on a steady state value necessary to hold the rotor 11 and the member 75 at a position corresponding almost exactly to the value of the command signal PC. There will be some small amount of droop, but the high gain of the amplifier 78 makes it negligible.

Of course, if the command signal PC is decreased and becomes less than the feedback signal PA, the error (PA-PC) is negative and the amplifier 78 makes the current *i* decrease. This reduces the magnetic torque T*m*, and permits the c.w. torque of the spring 55 to move the rotor 11 in a clockwise direction. Such action proceeds until the feedback signal PA decreases to make the error (PA-PC) very small. The rotor 11 comes to a steady state position almost in exact agreement with the magnitude of the command signal PC.

It is to be observed from FIG. 12 that since the spring preload torque $-Tsp$ is always present, and is equal approximately to one-half the maximum magnetic torque $Tmm$, the actuator as a whole may apply equal torques in c.w. and c.c.w. directions to move the throttle member 75 left or right. If the amplifier produces an extreme output of 0 or 10 amperes the approximate net torque supplied to the shaft 21 is either (a) $Tm - Tsp = Tmm - \frac{1}{2} Tmm = + \frac{1}{2} Tmm$, or (b) $0 - Tsp = 0 - \frac{1}{2} Tmm$. Thus, even though the magnetic attraction torque Tm acts in only the c.w. sense, the spring 55 with its relatively great preload makes the composite actuator system bi-directional and with a maximum output working torque essentially equal to one-half the maximum available magnetic torque.

Figure 11:
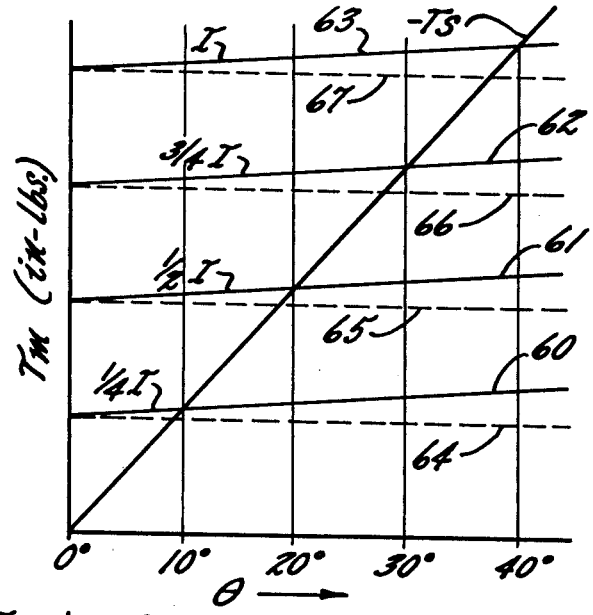
FIG. 11 is a graph showing the relationship of magnetically created torque vs. angular rotor position with applied excitation current held constant at various values.

An advantage flows from the slightly sloping torque vs. position characteristics 60-63 as shown in FIGS. 11 and 12. By choosing the scale factor for the spring 55 to represent a substantially corresponding slope, the spring is caused, in effect, to act with an essentially zero net spring constant. Or stated another way, the operating characteristics 60-63 of the magnetic actuator exhibit what may be called a "negative spring constant" which in large measure cancels the positive constant of spring 55. The steady state position of the rotor 11, for any value of the command signal PC and any steady state rotor position, is thus achieved when the feedback signal PA is such as to make the error (PA-PC) only slightly offset from zero and the amplifier output equal essentially to the mid-range value of 5 amperes. In other words, all steady state positions are represented by points which lie along the line 71 in FIG. 12 where the incremental spring torque $-Tss$ is partially cancelled by the incremental increase of magnetic torque with increasing $\theta$, which is reflected as the slope of the line 61. This means that the excitation current *i* need take on values of, say 4.8, 5.0 and 5.2 amperes to hold the rotor 11 at steady state positions of 0°, 20° and 40°, respectively. Due to the high gain of the amplifier 78, the error (PC-PA) to produce the steady state outputs of current over the range of 4.8 to 5.2 amperes is negligible, and for practical purposes the actual position signal PA is in all cases substantially equal to the commanded position signal PC.

In effect, therefore, the system of FIG. 13 functions as if the spring 55 were imposing an almost constant return torque on the rotor (i.e., as if the spring had a zero scale), and the ultimate steady state position in which the rotor resides is essentially proportional to the command signal PC. Almost the same full value of working torque (equal to the one-half maximum magnetic torque) is available to move the rotor 11 and the member 75 in either direction from one steady state position toward a different, newly commanded steady state position.

A further advantage results from the large preload, low scale spring employed in the fashion here described, together with the almost horizontal torque vs. position characteristics 60-63. Since the steady state value of the current $i$, when the rotor is at any position, is only slightly above or below the ½ I line 61 (FIG. 12) and is represented by a point on the line 71, the coil 14 need be sized, constructed and cooled to dissipate heat resulting from about 5 amperes steady state (assuming maximum torque coil current is 10 amperes). The coil may thus be smaller and less expensive in its construction as compared to the case illustrated in FIG. 11 (large spring scale and small or zero preload) which would require steady current of 10 amperes to hold the rotor at a steady state position nearly fully closed ($\theta = 40°$).

Figure 14:
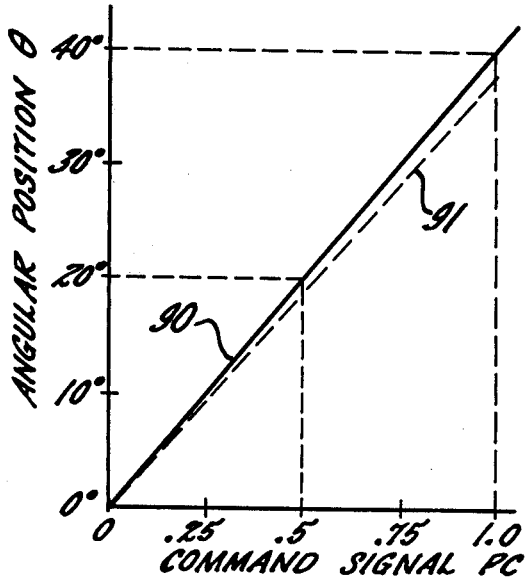
FIG. 14 is a graphical representation of the position versus command signal relationships for the system of FIG. 13.

Referring to FIG. 14, the relationship of steady state angular position $\theta$ to the command signal PC is there graphically shown. On the assumption (previously stated and illustrated in FIG. 12) that the spring 55 is selected and adjusted to make the angular position $\theta$ equal to 20° when the excitation current $i$ is 5.0 amperes and the input signal PC is 0.5 volt, the theoretically perfect relationship between angle $\theta$ and command signal PC is represented by the solid line 90. Due to the slight droop introduced by the proportional amplifier 78, however, the actual relationship obtained in a servo system like that of FIG. 13 will depart very slightly from the ideal —as represented by the dashed line 91 which exaggerates the droop for purposes of illustration. In practical usage the linear characteristic of the line 91 over a wide working range is satisfactory; and the present actuator employed in a positioning loop with feedback will make the rotor and the actuated member conform proportionally in their position to the value of the changeable input command signal PC.

We claim:

1. In an electromagnetic actuator, the combination comprising first and second members of magnetically permeable material, one of which is a stator and one of which is a rotor, means pivotally interconnecting said first and second members to swing relative to one another about an axis, said members being shaped to jointly form a closed ring with respective opposed extremities which approach toward or retreat from one another in jaw-like fashion as the swinging movement about said axis occurs to narrow or widen a gap therebetween, said first member's extremity being shaped to define a tapered tooth, said second member's extremity being bifurcated to form fingers defining a tapered mouth which substantially complements said tooth, thereby to create said gap in two substantially equal halves lying respectively between the surfaces of said tooth and the opposed complemental surfaces of said mouth, and a coil linked with the closed ring formed by said members and which, when excited, creates m.m.f. in such ring to establish magnetic flux threading the ring and dividing to pass in substantially equal halves across the two halves of said gap.

2. The combination set forth in claim 1 further characterized in that said tooth and said mouth are in the general configuration of the letter V.

3. The combination set forth in claim 2 further characterized in that said V-shaped tooth and mouth are arcuate in nature with center lines lying along a common arc having a radius extending from said axis.

4. The combination set forth in claim 3 wherein the inner and outer surfaces of said tooth and the inner and outer surfaces which define said mouth are all arcuate in shape.

5. In an electromagnetic actuator, the combination comprising first and second members of magnetically permeable material, one of which is a stator and one of which is a rotor, means pivotally interconnecting said first and second members to swing relative to one another about an axis, said first and second members being shaped to jointly form a closed ring with respective opposed extremities which approach toward or retreat from one another in jaw-like fashion as the swinging movement about said axis occurs, said first member's extremity being shaped as an arcuate tapered tooth having an arcuate centerline lying on a first arc struck about said axis, and having inner and outer surfaces, respectively closer or farther from said axis, lying substantially along second and third arcs struck about first and second centers equally and diametrically displaced from said axis, said second member's extremity being shaped to define a tapered arcuate mouth which substantially complements said tooth, said mouth having an arcuate centerline lying along said first arc and having surfaces which, when the mouth is nested onto the tooth, lie on arcs of radii extending from said first and second centers and substantially equal to the respective radii of said second and third arcs, and a coil surrounding said first and second extremities while permitting the latter to move relatively in jaw-like fashion, electric excitation current through the coil creating magnetic attraction of the two extremities tending to close said mouth onto said tooth.

6. The combination set forth in claim 5, further characterized in that said first and second centers are located and disposed according to the following criteria:

a. from any point on said arcuate centerline of said tapered tooth, a radius line is drawn through said axis, b. a straight line is drawn through said axis normal to said radius line, c. locator lines are drawn from said point making a selected angle $\alpha/2$ on opposite sides of said radius line, and d. said first and second centers are at the intersections of said straight line with said respective locator lines.

7. The combination set forth in claim 6 wherein the value of $\alpha$ is between 15° and 26°.

8. The combination set forth in claim 5, further characterized in that the said extremity of said second member is shaped to have arcuate exterior surfaces which are coaxial with the arcuate centerline of said mouth.

9. The combination set forth in claim 5, further characterized in that said coil is mounted in fixed relation to said first member and shaped to define an interior passageway which closely conforms to the exterior shape of said second member's extremity when the latter is positioned such that said mouth is substantially fully nested onto said tooth.

10. The combination set forth in claim 8, further characterized in that said coil is mounted in fixed relation to said first member and is shaped to define an interior passageway, said passageway having curved interior walls lying substantially on arcs struck about said axis and which are closely spaced from the arcuate exterior surfaces of said second member's extremity when the latter is substantially fully nested onto said tooth.

11. In an electromagnetic actuator, the combination comprising a stator of magnetically permeable material, a rotor of magnetically permeable material pivotally interconnected with the stator to swing about an axis, said stator having an arcuate tapered tooth shaped to have its centerline lying on an arc struck about said axis, and with its inner and outer surfaces, closest to and farthest from said axis, lying on arcs struck about first and second centers equally and diametrically displaced from said axis, said rotor having a body extremity shaped to define an arcuate mouth which substantially complements said tooth, and which is capable of closing onto said tooth in substantially fully nested relationship if the rotor is swung to a fully closed position, said mouth having interior arcuate surfaces of radii substantially equal to the radii of said arcs and struck about first and second centers when the mouth is fully nested, a coil fixed in stationary relation to said stator and substantially surrounding the tooth tip and the rotor extremity defining said mouth, and means forming a magnetically permeable coupling between said rotor and stator in the region of their pivotal connection, so that current excitation of said coil creates magnetic flux in a closed path which includes said stator, the gap between the opposed surfaces of said tooth and mouth, and said rotor, whereby the magnetic attraction forces between (a) the inner pair of opposed surfaces and (b) the outer pair of opposed surfaces, closest to or farthest from said axis, both contain (i) first force component vectors which lie along radii extending through said axis and (ii) second force component vectors which lie normal to said radii, said first force component vectors opposing and at least partially cancelling and said second force component vectors aiding and tending to swing the rotor mouth toward nesting with said tooth.

12. The combination set forth in claim 11, further characterized in that said tooth and said mouth have a common arcuate centerline lying on an arc struck about said axis, and said mouth has interior arcuate sidewalls which, when closed on said tooth, substantially conform to said inner and outer tooth surfaces.

13. The combination set forth in claim 11, further characterized in that said stator tooth inner and outer surfaces merge into the side surfaces of a tooth base portion, said side surfaces lying on arcs of different radii about said axis, and said rotor body extremity is formed with exterior surfaces which lie on extensions of the lastnamed arcs.

14. The combination set forth in claim 11, further characterized in that said first and second centers lie equidistant from said axis on a line through the axis, said line being normal to a radius extending from said axis to a point on said tooth centerline.

15. The combination set forth in claim 14, further characterized in that two lines extending from said point respectively to said first and second centers form an angle $\alpha$, where $\alpha$ has a value between 15° and 26°.

16. The combination set forth in claim 11, further characterized in that said body extremity is shaped to have arcuate exterior surfaces which are coaxial with the arcuate centerline of said tooth.

17. The combination set forth in claim 11, further characterized in that said coil is shaped to define an interior passageway with walls closely conforming to the exterior surfaces of said body extremity when said mouth is substantially fully closed on said tooth.

18. The combination set forth in claim 16, further characterized in that said coil is shaped to define an interior passageway having arcuate interior walls which lie substantially on arcs struck about said axis, and which lie closely spaced from the arcuate exterior surfaces of said body extremity when said mouth is fully closed on said tooth.

* * * * *